United States Patent [19]

Boerner

[11] Patent Number: 5,060,820

[45] Date of Patent: Oct. 29, 1991

[54] PLATE ASSEMBLY

[76] Inventor: Gergory J. Boerner, 9505 Pagewood, Houston, Tex. 77063

[21] Appl. No.: 536,203

[22] Filed: Jun. 11, 1990

[51] Int. Cl.[5] ..... A47G 19/03

[52] U.S. Cl. ..... 220/574; 220/23.83; 206/501; 206/821

[58] Field of Search ..... 220/574, 23.83, 23.86; 206/501, 821

[56] References Cited

U.S. PATENT DOCUMENTS

| | | | |
|---|---|---|---|
| D. 211,532 | 6/1968 | Ashton . | |
| 1,688,992 | 10/1928 | Smith . | |
| 1,937,939 | 12/1933 | Behrens . | |
| 1,955,919 | 4/1934 | Kress | 206/501 |
| 2,050,061 | 8/1936 | McCaskell | 229/3.5 R |
| 2,110,612 | 3/1938 | Skinner et al. | 229/3.5 R |
| 2,518,368 | 8/1950 | Peters . | |
| 2,721,459 | 10/1955 | Berg | 220/23.83 |
| 2,755,644 | 7/1956 | Watson . | |
| 3,078,005 | 2/1963 | Lewerth . | |
| 3,173,574 | 3/1965 | Goldsmith | 206/821 |
| 3,526,335 | 9/1970 | Swett et al. | 220/23.83 |
| 3,885,672 | 5/1975 | Westenrieder | 206/821 |
| 3,955,672 | 5/1976 | Brundage . | |
| 4,234,097 | 11/1980 | Daener | 206/501 |
| 4,452,581 | 6/1984 | Panehal | 220/23.83 |
| 4,461,396 | 7/1984 | Harper | 220/23.83 |
| 4,732,274 | 3/1988 | Bouton . | |
| 4,823,958 | 4/1989 | Mahmud . | |

*Primary Examiner*—Joseph Man-Fu Moy

*Attorney, Agent, or Firm*—Pravel, Gambrell, Hewitt, Kimball & Krieger

[57] ABSTRACT

A plate capable of being grasped simultaneously along with a beverage container using just one hand. Attached to the bottom surface of the food bearing member of the plate is a member or members which, when deployed, enable the user to place the plate over a beverage container and grasp both the beverage container and the plate member with one hand, thus freeing the other hand for other tasks, such as manipulating the food or greeting.

10 Claims, 3 Drawing Sheets

PLATE ASSEMBLY

BACKGROUND OF THE INVENTION

1. Field of the Invention

This invention relates to a food serving plate and, more particularly, to a plate designed to enable both the plate and a beverage container to be held simultaneously with only one hand.

2. Description of the Prior Art

Most of the consumption of food on the part of humans is carried out while the diner is seated at a table. The table serves to hold the various plates, beverage containers, and eating utensils freeing the diner's hands to manipulate the food and drink, among other things.

However, a significant amount of food consumption takes place in the absence of a table or a similar structure on which the food and drink can be conveniently supported. For example, as part of many social functions, guests consume food and drink while standing and socializing with each other, far from any convenient structure on which the drink or the plate can be supported. Such a situation requires that the food and drink be continuously supported by the guest.

Since one hand is typically required to support the plate and another hand is required to manipulate the food on the plate, as, for example, with a fork, and since yet another hand is required to support and manipulate the beverage container, the two-handed social guest is left with an annoying dilemma.

One placed in this situation may forego the food and simply drink, or one may forego the drink and content oneself with the food. Alternatively, one may consume both the drink and the food but do so sequentially, i.e., finish doing one before starting the other, rather than doing both more or less simultaneously as would be most desirable.

One in a position of a guest determined to have both one's food and one's drink concomitantly is forced to resort to either of two unfortunate compromises. One can position oneself close to a table or similar structure on which one can rest one's drink between sips. Alternatively, one can precariously balance one's food-laden plate on top of one's beverage container whenever one desires to partake of one's food.

The first option physically confines the guest to a particular location, usually away from the center, and severely limits the guest's ability to mingle and socialize. The second option can have dire implications for business suits, evening gowns and carpeting.

There is thus a widely recognized need for a convenient and inexpensive means for simultaneously holding a food serving plate and a beverage while using only one hand, thereby freeing the other hand to carry out such tasks as manipulating a fork or shaking hands in greeting.

Various attempts have been made to solve this problem. U.S. Pat. No. 4,732,274 discloses a portable tray table. Included integrally in the tray is a cup holder extending through the tray surface and downward from the center of the tray. The cup holder can be grasped by one hand to support the tray. The tray structure is very complex and would be expensive to produce. Because of the complexity of the structure the material of construction for the device would, in practice, be limited to rigid substances. Furthermore, having the cup holder in the middle of the tray robs the tray of some of the prime space which could have been utilized for the holding of food.

U.S. Pat. No. Des. 211,532 shows a serving tray which is made up of a triangular flat plate having a circular central downward extending member at the middle of the plate which appears to be capable of holding a beverage container. Similarly, U.S. Pat. No. 4,823,958 discloses a food and beverage serving device. The device includes a beverage receptacle having an outward extending flange on which food can be supported. Here too, the structures disclosed in the two references is limited to rigid materials of construction and much of the space which would have been occupied by food is preempted to accommodate the beverage container holder.

U.S. Pat. No. 3,955,672 discloses a plate assembly which includes a cup support member located at a point near the edge of the plate which is integrally formed with the body of the plate assembly. In use, the support member is grasped by one hand while the plate assembly rests on the forearm to give the acentrically loaded assembly added stability. While this assembly places the beverage holder to one side of the plate, the presence of the holder continues to rob scarce plate space which would have been better utilized to accommodate food. In addition, shifting the holder from the center of the plate, as in the references discussed above, to the side, as in the '672 patent, introduces considerable instability. Such instability would be particularly disadvantageous, particularly where paperboard plates, rather than rigid plastic plates, are used. The disclosure of the '672 patent acknowledges the inherent instability when it recommends that the plate be supported on the forearm in addition to being grasped around the beverage holder.

Other solutions have also been proposed. For example, plastic devices are commercially available which can be temporarily attached at one of its ends onto the edge of a plate. The other end of the device is configured so as to accept a beverage container. A disadvantage of this device is that it tends to destabilize the plate and cause it to tilt or bend in one direction.

It would be desirable to have a convenient and inexpensive way of simultaneously holding both a food plate and a beverage container using only one hand. Specifically, there is a clear need for, and it would be highly advantageous to have, a cheaply mass-produced plate which would allow one to hold both the plate and a beverage container using only one hand without significantly increasing the chance of spillage of either the food or the drink.

SUMMARY OF THE INVENTION

This invention successfully addresses the shortcomings of the presently known configurations by providing a simple, inexpensive, and readily mass-produced structure which would make it possible for one to hold a plate and a beverage with a single hand but which would be highly stable and unlikely to lead to spills or accidents.

This invention discloses a novel plate which differs from commonly found plates in that its bottom surface is modified so as to include one or more members capable of extending downward from the bottom of the plate and fitting over or along a beverage container, such as a glass, a cup, a soda or beer can, a bottle, or the like, and which may be grasped with the same hand used for grasping the beverage container.

More specifically, the plate of this invention, which can be made of rigid material, such as plastic or ceramic, or of a more flexible material, such as paperboard, wicker, and the like, includes one or more members connected in some convenient fashion to the bottom of the food bearing member of the plate. Typically, the food bearing member will be constructed of paperboard and the downward extending member or members will be designed to lie essentially flat against the bottom of the plate prior to deployment so as to facilitate transport and handling and to save storage and packaging space.

Prior to use, the member or members is caused to extend downward from the bottom of the plate in a direction approximately perpendicular to the bottom of the plate. The plate can then be placed directly over a beverage container, such as a cup or can and the fingers grasping the beverage container are shifted slightly so as to grasp the downward extending member or members along with the beverage container so as to securely stabilize the plate. In an alternative embodiment, the downward extending member is so configured as to be capable of stabilizing the plate merely through contact with the beverage container without the need for grasping the member with the fingers.

BRIEF DESCRIPTION OF THE DRAWINGS

The above and other embodiments of the present invention may be more fully understood from the following detailed description when taken together with the accompanying drawing wherein similar reference characters refer to similar elements throughout and in which.

DESCRIPTION OF THE PREFERRED EMBODIMENTS

The present invention is of a plate or similar structure which can be grasped simultaneously with a beverage container or similar device using only one hand. Specifically, this invention can be used to enable one to grasp both the plate and a beverage container with a single hand, thereby freeing the other hand to carry out other functions, such as to manipulate the food on the plate, as with the aid of a fork, or to shake hands in greeting.

Figure 1:
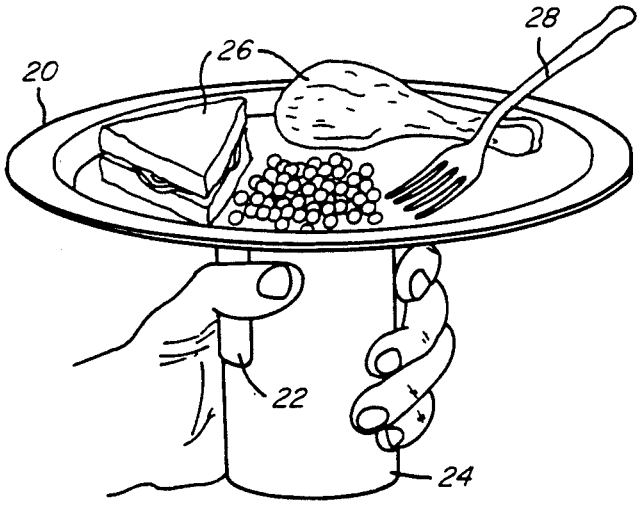
FIG. 1 is a perspective view of one embodiment of the invention in use with a can.

Referring now to the drawing, FIG. 1 illustrates the plate of this invention, generally designated 20, in operation. Connected to and extending downward from the bottom of the plate 20 are a pair of members 22. The members 22 can be manufactured as integrated parts of the plate or can be attached, as with adhesive, as part of the manufacturing process.

Whenever the user desires to grasp both the beverage container 24 and the plate 20, the user slips the plate 20 over the top of the beverage container 24, so that the members 22 lie along, and on either side of, the container 24. The user then shifts the fingers and thumb, or some subset thereof, so as to simultaneously grasp both the downward extending members 22 and the beverage container 24. Having done this, the user is then able to freely use the other hand to load food 26 onto the plate 20 or to manipulate the food 26, with or without the aid of a utensil such as a fork 28.

Whenever one desires to partake of one's beverage, one places one's fork 28 on the plate 20 and shifts one's fingers and thumb as appropriate so as to release the pressure on the downward extending members 22. Using one's free hand, one can then grasp the plate 20 and pull it away from the beverage container 24. This effectively removes the cover from the beverage container 24 and allows the user to drink from the beverage container 24.

Figure 2:
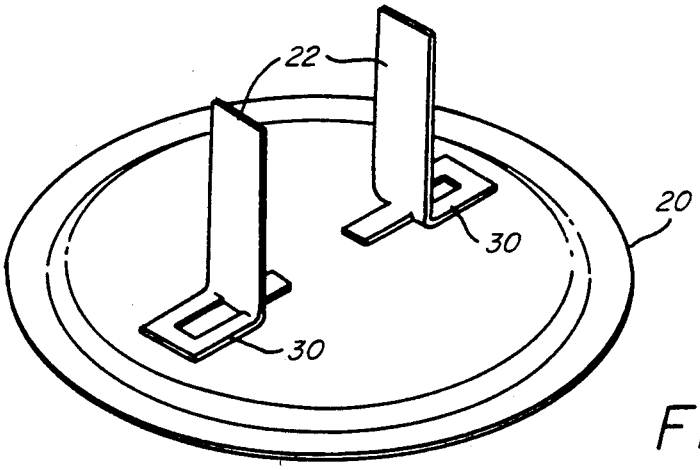
FIG. 2 is a perspective view of the bottom of the plate of FIG. 1.

Referring now to FIG. 2 of the drawing, a bottom perspective view of the plate 20 is shown in order to demonstrate one possible configuration for the attachment of the downward extending members 22 to the bottom of the plate 20. The downward extending members 22 are shown to be attached to the plate 20 by means of tabs 30 which are firmly connected to, or are an integral part of, the members 22 which are in turn attached, by, for example, the use of adhesive, to the bottom of the food bearing member of the plate 20.

As will be readily apparent to one ordinarily skilled in the art, the use of precisely two downward extending members is not obligatory. A single member may be used, as will be demonstrated below. Similarly, more than two downward rotating members 22 may also be effectively used.

Figure 3:
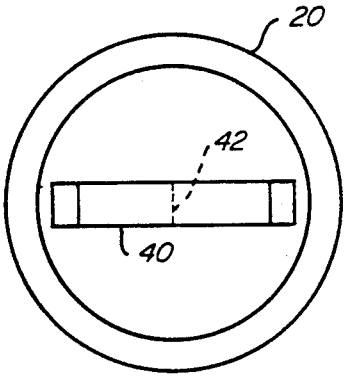
FIG. 3 is a plane view of the bottom of the plate of FIG. 1 showing a possible configuration of the downward extending members prior to deployment.
Figure 4:
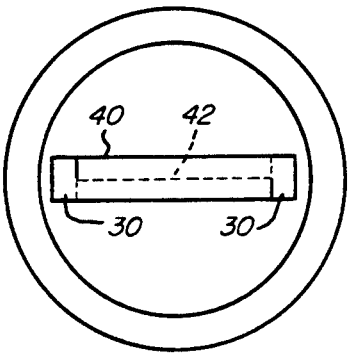
FIG. 4 is a view of the bottom of the plate of FIG. 1 showing another possible configuration of the downward extending member prior to deployment.
Figure 5:
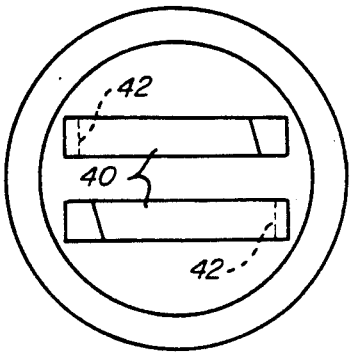
FIG. 5 is a view of the bottom of the plate of FIG. 1 showing yet another possible configuration of the downward extending member prior to deployment.

Referring to FIG. 3, 4 and 5, three bottom views are shown demonstrating three of many possible configurations of the downward extending members 22 prior to their deployment. In the configuration shown in FIG. 3, the two downward extending members can be deployed by perforating along the perforation line 42 of a single strip 40 which is attached to the bottom of the plate 20 as in FIG. 2. Another possible configuration is shown in FIG. 4. In this configuration, the perforations 42 extend parallel to and for the entire length of the extended portions of the downward extending members, as well as cross-wise at the extended ends of each of the members. This configuration may have the advantage over that shown in FIG. 3 of being capable of producing two members which are longer than those which can conveniently be produced with the configuration of FIG. 3.

Yet another configuration is shown in FIG. 5. In this configuration two downward extending members can be deployed by tearing along perforations 42 located on two strips 40. Each strip 40 is attached to the bottom surface of the plate at its non-perforated end in such a way as to permit each strip 40 to twist slightly toward the other strip 40 and thereby facilitate use of the strips for the purposes of this invention.

The strip forming the downward extending members can be of any length and width which would permit the strip to function adequately. The downward extending member should be from ½ inch to 6 inches in length and from ¼ inch to 12 inches in width.

The plate of this invention can be constructed of any convenient material. The invention can be applied to any rigid plate, such a one made of plastic or ceramic. The invention is preferably applied in conjunction with plates constructed of paperboard, most preferably disposable paperboard plates.

The plate or similar device is supported by the beverage container at or near the plate center, much the same way the palm of the hand is used to support an ordinary plate. There is thus little risk of the plate bending at the edges, provided that the ratio of surface area of the food bearing member to that of the beverage container is not too great for the degree of rigidity of the plate.

The downward extending members can also be constructed of any suitable material, most conveniently of the same material as that of the plate. Preferably the members attached to disposable paperboard plates will also be made of paperboard.

The application of this invention is not limited to standard plates, but extends equally to any surfaces or devices which directly or indirectly bear food. For example, the present invention can be beneficially applied by providing extension members for a plate holder, such as a wicker structure into which a paperboard is inserted prior to use. The paperboard plates is loaded with food and the reusable plate holder is used to give the loaded paperboard plate added stability. At the end of the meal, the paperboard plate is discarded while the plate holder, modified according to the present invention, is stored for future use.

Similarly, the present invention is not limited to a flat plate or to structures which are substantially horizonal. The present invention can be usefully employed in conjunction with a wide variety of plate structures, such as bowls, trays, and the like, provided that such structures have at least one surface, preferably centrally located, which is substantially horizontal and which will be adequately supported by a beverage container. All such structures have been denoted for purposes of this invention as plates.

To one ordinarily skilled in the art it will be clear that the present invention is not limited to use in connection with foods and beverages, but rather can be used wherever it is desired to grasp a plate-like device and a beverage container-like structure simultaneously using only one hand. Many such uses are possible and can be contemplated. For example, an artist may wish to be able to grasp a palette and a water container in one hand, freeing the other hand to paint.

Figure 6:
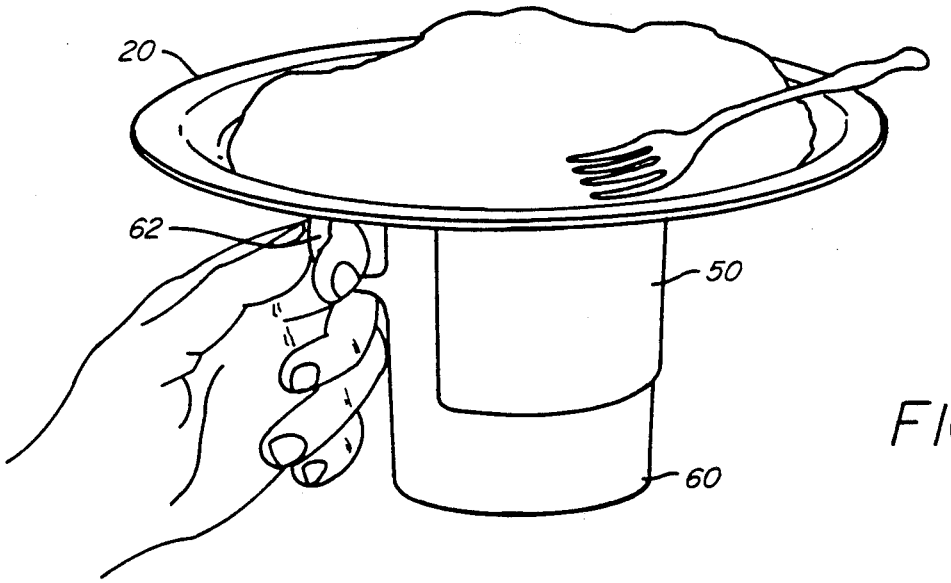
FIG. 6 is a perspective view of the embodiment of FIG. 7 in use with a cup.
Figure 7:
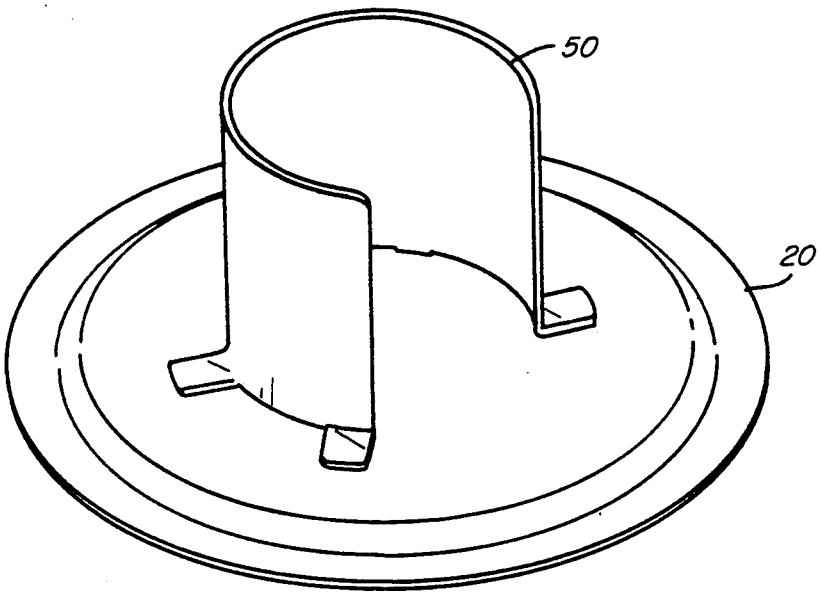
FIG. 7 is a perspective view of another embodiment of the plate.

FIG. 6 and 7 show another embodiment of the present invention. This embodiment involves a single substantially cylindrical downward extending member 50. The member 50, rather than being a strip as in FIG. 1, now extends cylindrically over more than 180 degrees but less than 360 degrees. Such an embodiment can be used where it is desired to use the plate 20 in conjunction with a certain sized cup having a handle 62. This is particularly useful where the cup holds a hot drink making it uncomfortable if not impossible to grasp the cup as would be required in using the embodiment shown in FIG. 1.

Provided that the size of the cup 60 and the diameter of the downward extending member 50 are reasonably well matched, the cup can be held simply by grasping its handle 62. The plate 20 will in turn be supported by the cup 60 without the need for the user to directly touch the body of the cup 60.

A related embodiment, not shown in the figures, which can readily be used, especially when the beverage container has no handle, such as in the case of a can of soda or beer, features a downward extending member which forms a complete cylinder. In use, the cylindrical member would be slipped downward over the can or other beverage container and would stay in place regardless of whether the user's fingers were touching the cylindrical member.

Figure 8:
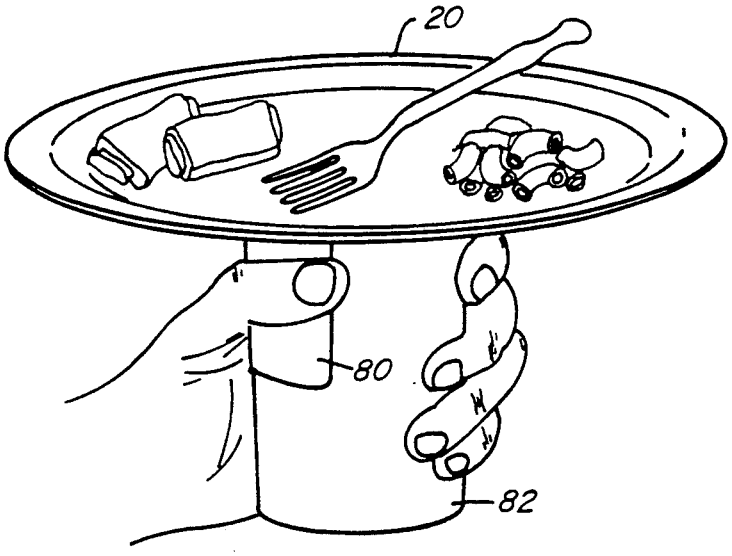
FIG. 8 is a perspective view of another embodiment of the plate in use with a glass.
Figure 9:
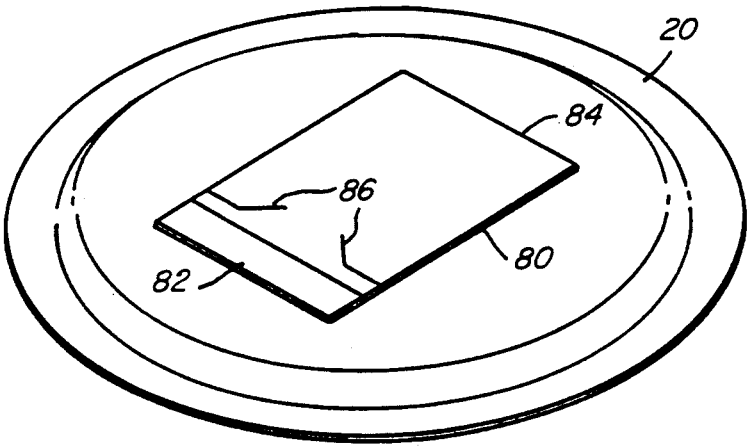
FIG. 9 is a view of the bottom of the plate of FIG. 8 showing a possible configuration of the downward extending member prior to deployment.
Figure 10:
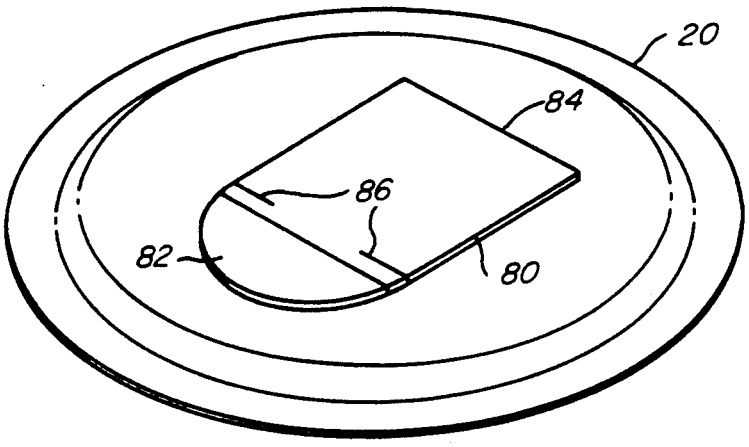
FIG. 10 is a view of the bottom of the plate of FIG. 8 showing another possible configuration of the downward extending member prior to deployment.

The preferred embodiment of the present invention is shown in FIG. 8, 9, and 10. The embodiment features a single downward extending member 80. Prior to deployment, the member 80 lies flat against the bottom of the plate 20 with one end 82 of the member 80 attached, as by use of adhesive, to the bottom surface of the food bearing member. The other end 84 of the member 80 is not attached to the plate. The member 80 features appropriately cut slits 86.

To deploy the member 80, the user, while holding the plate 20 in one hand, grasps the downward extending member 80 between the thumb and forefinger of the other hand and bends the loose end 84 of the member 80 along the slits 86 so as to render the unattached end 84 of the member 80 substantially perpendicular to the plate 20. This forms a member 80 which is of cylindrical shape but which extends through an angle of up to approximately 360 degrees.

The bent edges along the slits 86 serve to keep the member 80 perpendicular to the plate and prevent the member 80 from returning to a position wherein the member 80 lies flat against the bottom of the food bearing member. To grasp both the plate and a beverage container, one need only shift one's fingers slightly so as to be able to grasp the downward extending member 80 together with the beverage container 82.

It is seen that the present invention and the embodiments disclosed herein are well adapted to carry out the objectives and obtain the ends set forth at the outset. Certain changes can be made in the method without departing from the spirit and the scope of this invention. It is realized that changes are possible and it is further intended that each element recited in any of the following claims is to be understood as referring to all equivalent elements for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

Those skilled in the art may find many variations and adaptations thereof, and all such variations and adaptations, falling within the true scope and spirit of applicant's invention, are intended to be covered thereby.

What is claimed is:

1. A food serving plate capable of being held simultaneously with a beverage container using just one hand, comprising:

a food bearing member having a bottom surface extending substantially horizontally and having a top surface free from apertures; and an extension member, disposed flat against the bottom surface of the food bearing member prior to deployment, located so as to at least partially surround a central portion of the bottom surface, one end of which is securely affixed to the bottom surface of the food bearing member and the other end of which can be extended away from the bottom surface of the food bearing member so as to allow the extension member and the beverage container to be simultaneously grasped.

2. A plate as in claim 1 wherein the food bearing member is constructed of plastic, ceramic or paperboard.

3. A plate as in claim 1 wherein the food bearing member is constructed of paperboard.

4. A plate as in claim 1 wherein the food bearing member and the extension member are constructed of paperboard.

5. A plate as in claim 1 wherein the extension member is a strip of from ½ inch to 6 inches in length and from ¼ inch to 12 inches in width.

6. A plate as in claim 1 wherein the extension member is permanently attached to the bottom surface of the food bearing member.

7. A plate as in claim 1 wherein the extension member is attached to the bottom surface of the food bearing member with adhesive.

8. A food serving plate capable of being held simultaneously with a beverage container using just one hand, comprising:

a food bearing member having a bottom surface extending substantially horizontally and having a top surface free from apertures; and an extension member, disposed flat against the bottom surface of the food bearing member prior to deployment, located so as to at least partially surround a central portion of the bottom surface, attached to the bottom surface of the food bearing member which, when deployed, extends away from the bottom surface of the food bearing member so as to allow the extension member to fit over the beverage container.

9. A plate as in claim 8 wherein the extension member is permanently attached to the bottom surface of the food bearing member.

10. A plate as in claim 8 wherein the extension member is attached to the bottom surface of the food bearing member with adhesive.

* * * * *